US012280930B2

(12) United States Patent
Lee

(10) Patent No.: US 12,280,930 B2
(45) Date of Patent: Apr. 22, 2025

(54) HOLDER FOR ORGANIZATION

(71) Applicants: EZEN KOREA CO., LTD., Hanam-si (KR); Jae Yeol Lee, Seoul (KR)

(72) Inventor: Jae Yeol Lee, Seoul (KR)

( * ) Notice: Subject to any disclaimer, the term of this patent is extended or adjusted under 35 U.S.C. 154(b) by 0 days.

(21) Appl. No.: 18/270,519

(22) PCT Filed: Jan. 30, 2023

(86) PCT No.: PCT/KR2023/001341
§ 371 (c)(1),
(2) Date: Jun. 30, 2023

(87) PCT Pub. No.: WO2023/163396
PCT Pub. Date: Aug. 31, 2023

(65) Prior Publication Data

US 2025/0011060 A1 Jan. 9, 2025

(30) Foreign Application Priority Data

Feb. 25, 2022 (KR) ..... 10-2022-0025410

(51) Int. Cl.

| | |
|---|---|
| ***B65D 85/24*** | (2006.01) |
| ***B25H 3/00*** | (2006.01) |
| ***B65D 67/02*** | (2006.01) |
| ***B65D 83/02*** | (2006.01) |

(52) U.S. Cl.
CPC ..... *B65D 67/02* (2013.01); *B65D 83/02* (2013.01)

(58) Field of Classification Search
CPC ..... B65D 67/02; B65D 83/02; B65D 85/20; B25H 3/00; A45F 5/00
USPC ..... 206/338, 340, 341, 348, 349, 443; 24/336, 339; 248/65, 74.1, 74.2
See application file for complete search history.

(56) References Cited

U.S. PATENT DOCUMENTS 5,967,316 A * 10/1999 Abbruzzese ..... B65B 13/027 206/820
6,343,693 B1 * 2/2002 Finley ..... A45F 5/00 24/336
6,681,931 B2 * 1/2004 Finley ..... B25H 3/00 24/336

(Continued)

FOREIGN PATENT DOCUMENTS

KR 20-0485377 12/2017
KR 10-2288861 8/2021

OTHER PUBLICATIONS

English Specification of 10-2288861.
English Specification of 20-0485377.

*Primary Examiner* — Luan K Bui
(74) *Attorney, Agent, or Firm* — ANTONIO HA & U.S. PATENT, LLC

(57) ABSTRACT

The holder for organization according to the present invention comprises a main body configured to have an accommodation space for accommodating a to-be-organized object therein and an entrance formed on one side of the main body for introducing or withdrawing the to-be-organized object into the accommodation space; an opening/closing unit configured to close the entrance and open the entrance while sliding when pressed by the to-be-organized object; and a holder unit configured to press and hold the to-be-organized object passing through the opening/closing unit and accommodated in the accommodation space toward the opening/closing unit.

5 Claims, 6 Drawing Sheets

(56) References Cited

U.S. PATENT DOCUMENTS

| | | | | |
|---|---|---|---|---|
| 8,882,059 | B2 * | 11/2014 | Schmidt | F16L 3/1041<br>248/65 |
| 8,961,340 | B2 * | 2/2015 | Boatwright | A63B 60/42<br>473/568 |
| 2015/0122957 | A1 * | 5/2015 | Michiels | F16L 3/1075<br>248/74.1 |

* cited by examiner (a)

(b)

(c)

HOLDER FOR ORGANIZATION

TECHNICAL FIELD

The present invention relates to a holder for organizing, which can easily and quickly automatically organize to-be-organized objects, such as cable ties, disposable bags, straws, etc., and more particularly, to a holder for organizing, in which to-be-organized objects used for various purposes in various places such as various work sites, homes, and offices may be collected and organized in one place, and in particular, to-be-organized objects may be held and stored by pushing them into the arrangement holder in a one-touch manner, thereby improving convenience in use and facilitating portability, so that at the work site, cable ties can be quickly fixed as much as required for work and carried, as well as easily supplemented with cable ties that are gradually reduced due to use in work to reduce unnecessary time spent on work, thereby eliminating the inconvenient cable tie insertion method to reduce the user's stress and hassle and to maximize work efficiency.

BACKGROUND ART

In general, cable ties have different widths and lengths depending on their size, and there are many types of cable ties, but in general, ball-head type cable ties with slightly curved tails (See FIG. 6) are most commonly used because of their simple structure and easy fastening work.

Cable ties are used to neatly organize, tie, or fix wires for various industrial equipment and cables accompanying electrical or electronic equipment in various places such as work sites, homes, offices, and factories.

Further, cable ties are used for various purposes in various spaces, such as binding to each other or fixing to structures in order to organize various fixtures at home or offices.

In general, cable ties are used by opening the plastic packaging at the time of product shipment and taking out as much as necessary from that state. and in this case, an embarrassing situation may occur due to accidentally missing the opening and spilling on the floor, and in the case of a work site, cable ties are put in a tool box or tool pocket and spilled out after use, causing inconvenience to work as they are mixed with other tools.

Further, the lower tail of the ball head type cable tie and most commonly used cable ties is bent at a predetermined angle to facilitate insertion into the head of the cable tie, so when the cable ties remaining after use are put back into the plastic bag, the tail part is caught on the inlet side of the plastic bag, thus there is the inconvenience of not being able to put a plurality of cable ties in at once, but cable ties should be put in small amounts.

As a life idea to solve this inconvenience, a plurality of cable ties is bundled and stored with a rubber band or a single cable tie or carried and used at the work site.

However, while using cable ties at the work site, it is cut off or cable ties are gradually reduced, so this life idea has the inconvenience of having to constantly tighten them.

In order to solve the above problems, Korean Utility Model Registration No. 20-0485377 (title: portable cable tie holder) and Korean Patent Registration No. 10-2288861 (title: portable holder for cable tie) have been proposed.

However, considering that the tail part of the universally used cable tie is bent in the prior art, it is difficult to insert the required number of cable ties at a time when inserting cable ties because they get caught in the fixture or holder body, and in particular, when using cable ties for work, the number of cable ties decreases, so when supplementing cable ties, it is not possible to supplement the required number of cable ties at once, and they must be inserted individually between the remaining cable ties. Due to this, it is almost impossible to supplement the cable ties that are lacking during use at the work site, and even if they are supplemented, there is a problem in that it is cumbersome and time consuming to supplement one or two cable ties individually.

DISCLOSURE

Technical Problem

The present invention has been made to solve the problems of the prior art and relates to a holder for organization that can easily and quickly automatically organize to-be-organized objects such as cable ties, disposable bags, straws, etc. and form at least one door that slides when pressed by the to-be-organize object and forms an open area for passing the to-be-organized object to selectively and easily arrange various numbers of to-be-organized objects regardless of the number of to-be-organized objects, pressurize the organized objects toward the door, thereby stably holding to-be-organized objects and quickly and easily replenish the to-be-organized objects, and prevent the remaining to-be-organized objects from being unintentionally drawn out or separated when the held to-be-organized objects are taken out.

Technical Solution

The holder for organization according to the present invention comprises a main body configured to have an accommodation space for accommodating a to-be-organized object therein and an entrance formed on one side of the main body for introducing or withdrawing the to-be-organized object into the accommodation space; an opening/closing unit configured to close the entrance and open the entrance while sliding when pressed by the to-be-organized object; and a holder unit configured to press and hold the to-be-organized object passing through the opening/closing unit and accommodated in the accommodation space toward the opening/closing unit.

Further, rails are formed on one side and the other side of the entrance of the main body, respectively, and the opening and closing units open and close the entrance while sliding in a direction moving away from each other or approaching each other while being mounted on the rails, respectively.

Further, surfaces facing each other of the opening and closing units are in contact with each other, and the opening and closing units further comprise a return unit installed on the rail and elastically supporting the opening and closing units to return the opening and closing unit to its original position when the opening and closing units slide in the direction of opening the entrance.

Further, inclined surfaces are formed on the surfaces facing each other of the opening and closing units, respectively, for inducing the opening and closing units to slide in an opening direction of the entrance by being pressed by the to-be-organized object.

Further, the holder unit comprises a pair of pressure bars disposed opposite to each other with the main body interposed therebetween; a pivoting shaft installed through the main body and the pressure bars to guide the pressure bars to rotate; and pressing force generating units disposed on one side and the other side of the main body and elastically pushing the pressing bar toward the entrance to generate a pressing force of the pressing bar for the to-be-organized object located in the accommodation space.

Further, the holder unit further comprises friction units installed on one side of the pressure bars, respectively, for contacting the to-be-organized object located in the accommodation space; and a rotation limiting unit connecting the pressure bars and limiting a rotation angle of the pressure bar by contact with the opening and closing units.

Advantageous Effects

The holder for organization according to the present invention has an effect of easily and quickly hold and carry as many items as needed for work at the work site, such as cable ties, disposable bags, and straws and selectively and easily and conveniently organizing and holding various numbers of to-be-organized objects regardless of the number of to-be-organized objects.

Further, the holder for organization according to the present invention has an effect of stably holding them by pressurizing the to-be-organized objects and quickly replenishing them by pushing a new to-be-organized object to be replenished with one touch to reduce the time required for replenishment and improve work efficiency and prevent the remaining to-be-organized objects from being unintentionally drawn out or separated when the held to-be-organized objects are taken out.

MODE FOR INVENTION

Figure 1:
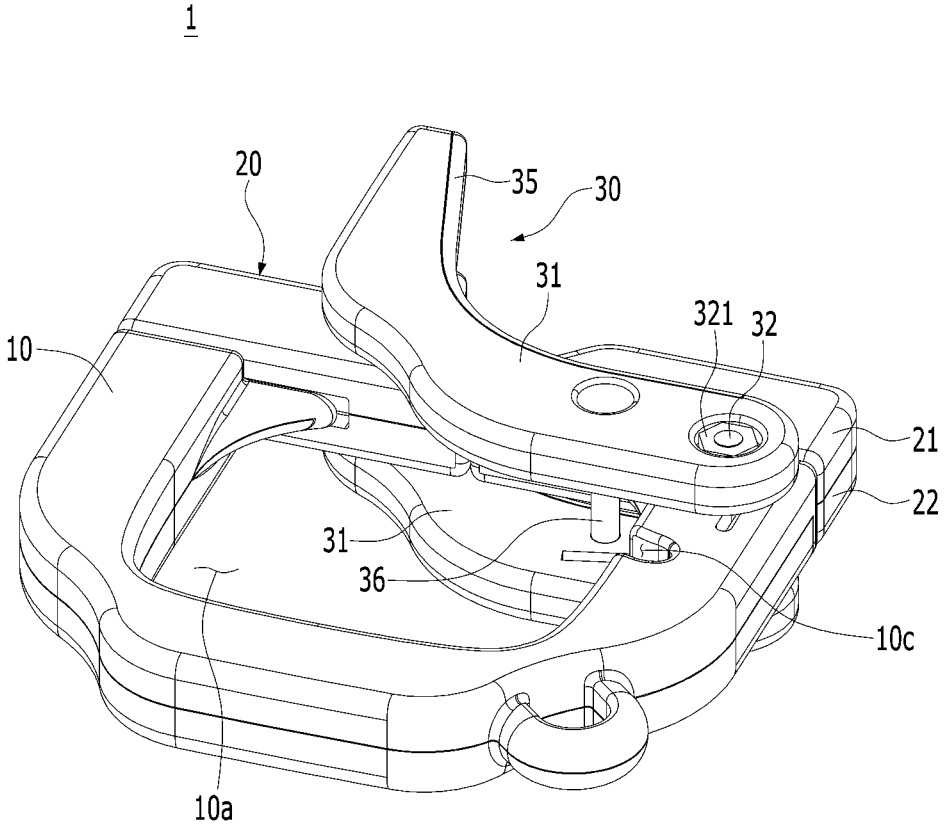
FIG. 1 is a perspective view showing a holder for organization according to an embodiment of the present invention.

Advantages and characteristics of the present invention, and methods for achieving them become clear with reference to the embodiments described later in detail.

However, the present invention is not limited to the embodiments disclosed below, but may be implemented in various different forms, only these embodiments are provided to make the disclosure of the present invention complete and completely inform those skilled in the art of the scope of the invention to which the present invention pertains, and the present invention is only defined by the scope of the claims. Like reference numbers designate like elements throughout the specification.

Hereinafter, embodiments of the present invention are described in detail with reference to the accompanying drawings so that those skilled in the art can easily carry out the present invention. However, the present invention may be embodied in many different forms and is not limited to the embodiments described herein. Like reference numerals have been assigned to like elements throughout the specification.

Figure 2:
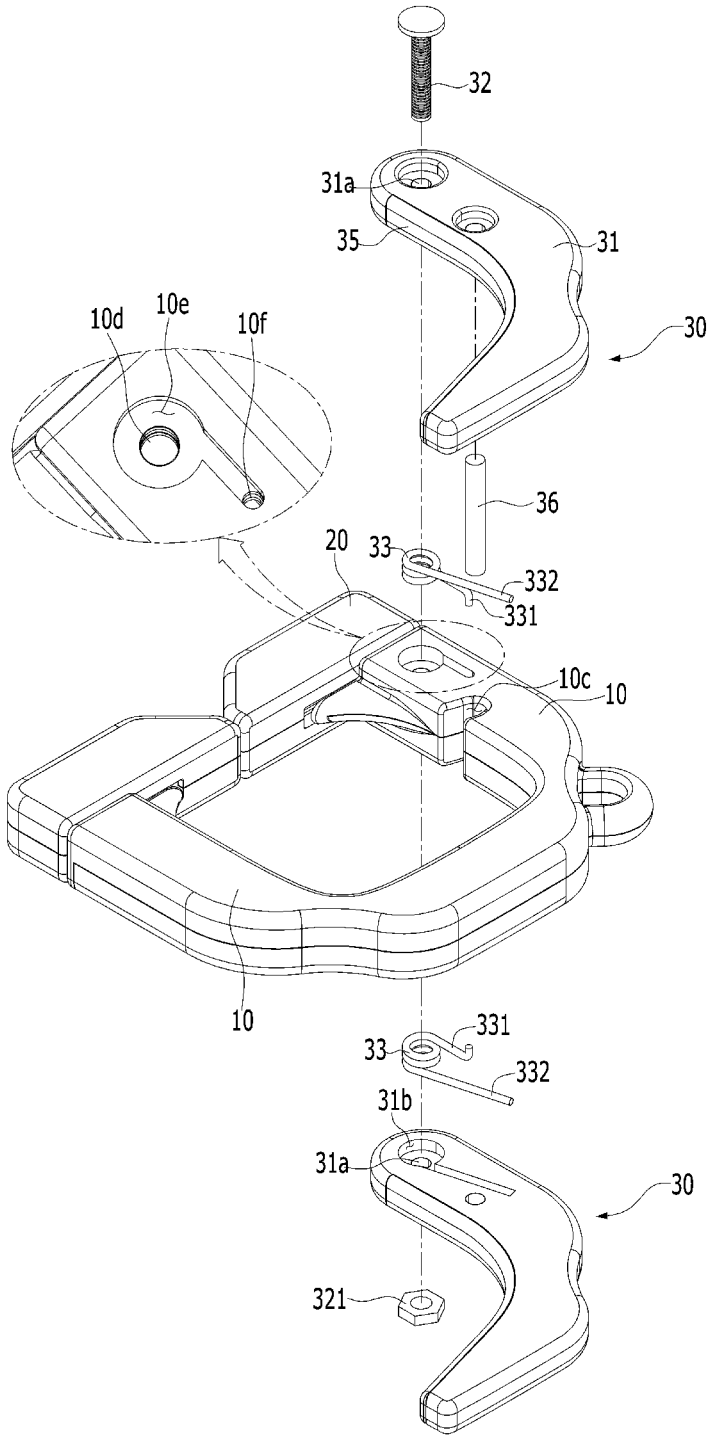
FIG. 2 is an exploded top perspective view showing a holder for organization according to an embodiment of the present invention.
Figure 3:
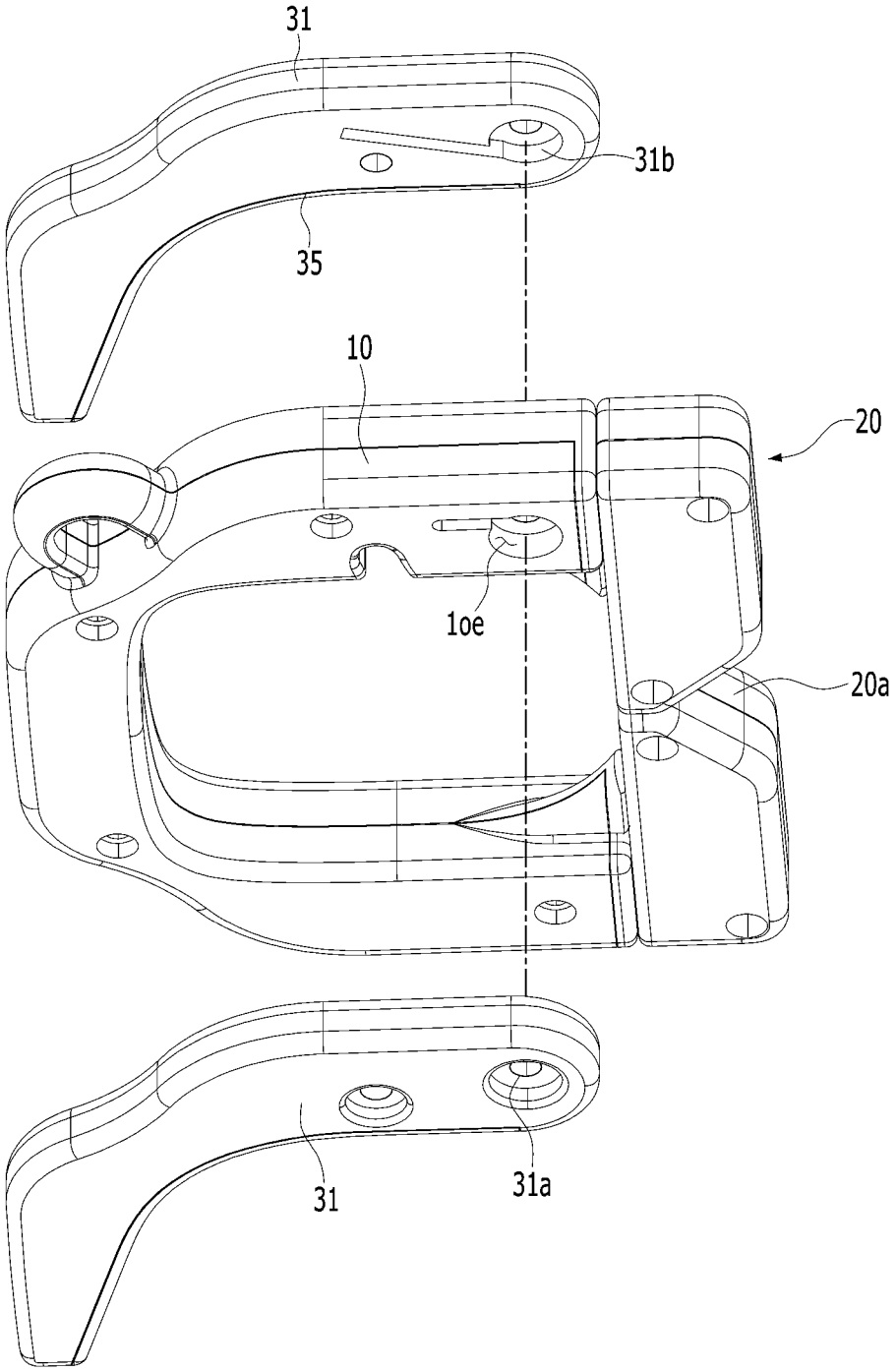
FIG. 3 is an exploded bottom perspective view of the bottom showing a holder for organization according to an embodiment of the present invention.
Figure 4:
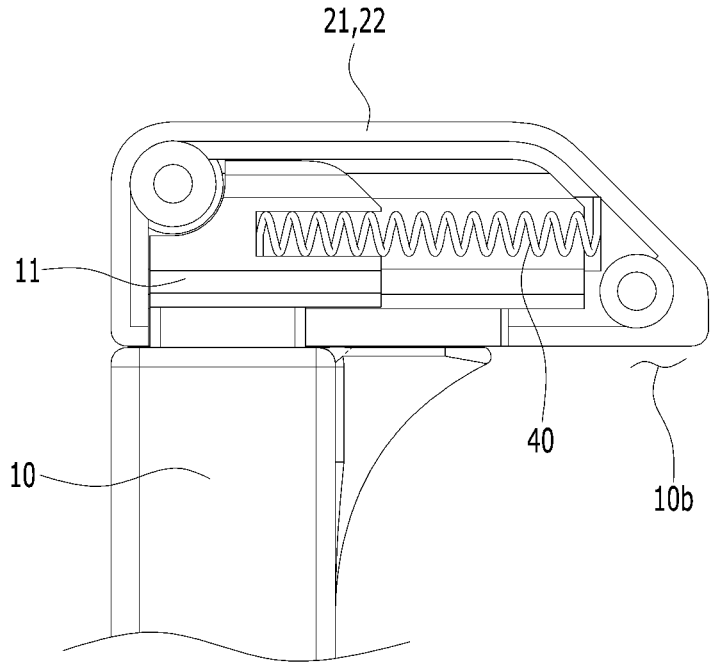
FIG. 4 is a view showing a main body, a rail, an opening and closing unit, and a return unit applied to a holder for organization according to an embodiment of the present invention.
Figure 5:
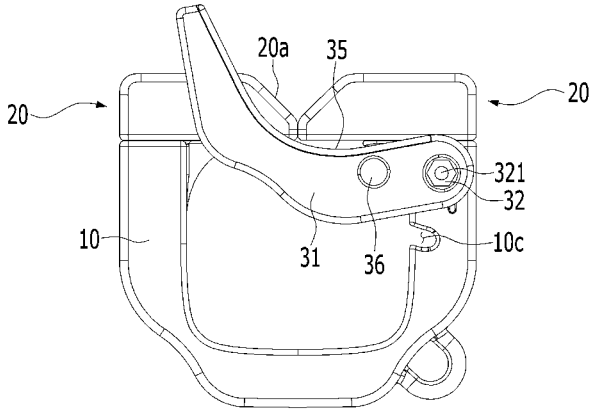
FIG. 5 is a plan view illustrating a process of organizing cable ties through a holder for organization according to an embodiment of the present invention.
Figure 5:
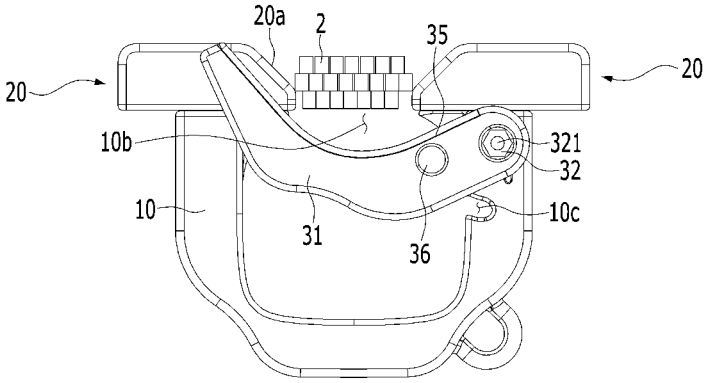
Figure 5:
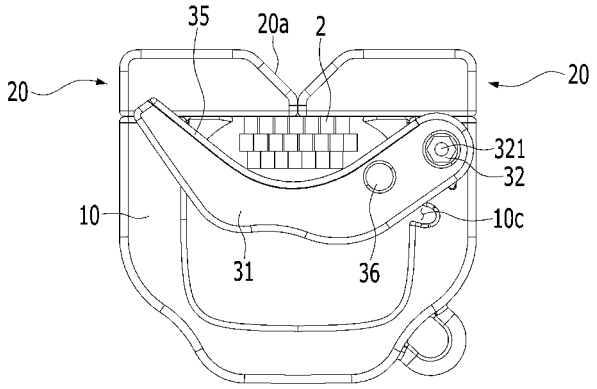
Figure 6:
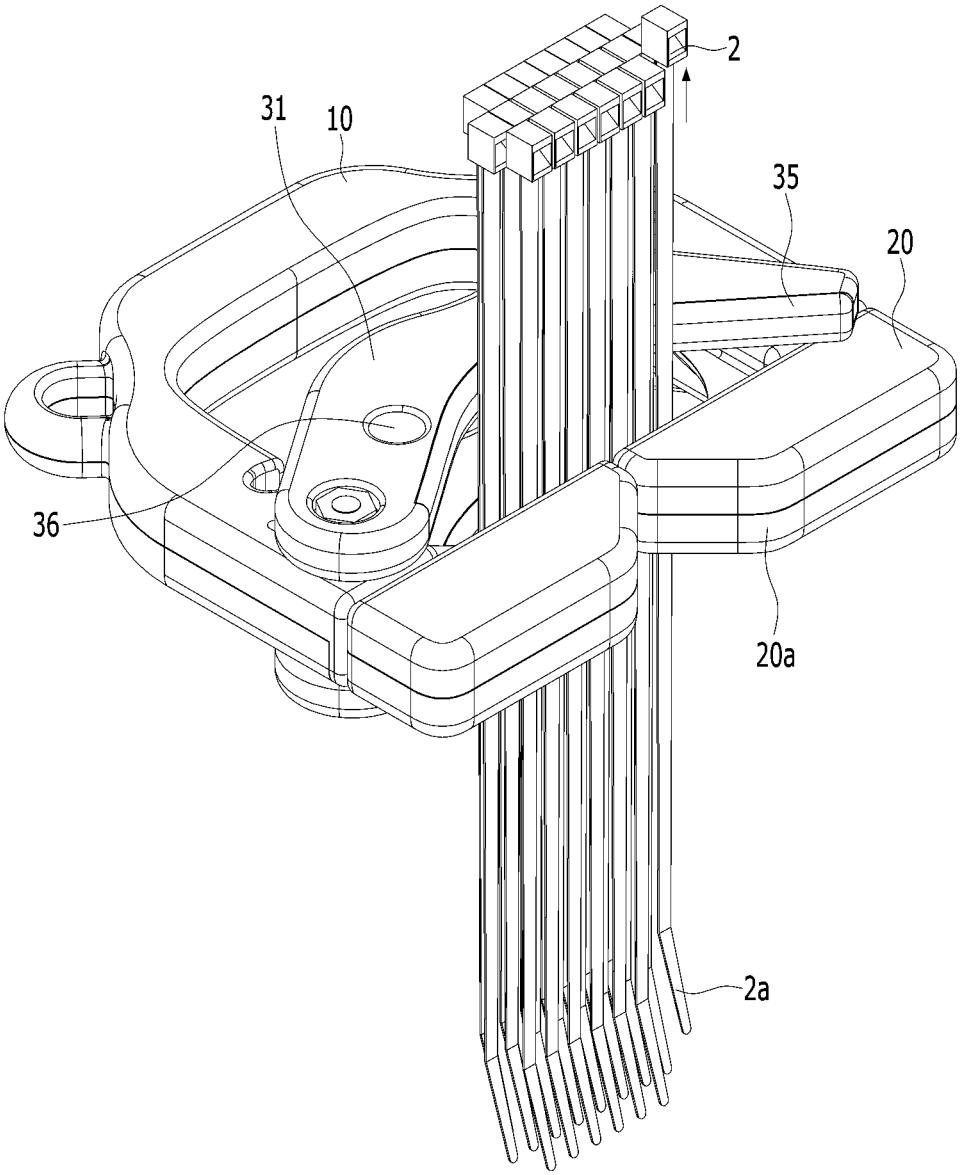
FIG. 6 is a perspective view showing a state in which cable ties are organized in a holder for organization according to an embodiment of the present invention.

FIG. 1 is a perspective view showing a holder for organization according to an embodiment of the present invention, FIG. 2 is an exploded top perspective view showing a holder for organization according to an embodiment of the present invention, FIG. 3 is an exploded bottom perspective view of the bottom showing a holder for organization according to an embodiment of the present invention, FIG. 4 is a view showing a main body, a rail, an opening and closing unit, and a return unit applied to a holder for organization according to an embodiment of the present invention, FIG. 5 is a plan view illustrating a process of organizing cable ties through a holder for organization according to an embodiment of the present invention, and FIG. 6 is a perspective view showing a state in which cable ties are organized in a holder for organization according to an embodiment of the present invention.

The holder for organization 1 according to an embodiment of the present invention is a product that can align and arrange the to-be-organized objects 2 in one place and particularly adopt a method of pushing the area between the upper and lower sides of the to-be-organized objects 2, rather than a method of pushing in from the upper or lower side of the to-be-organized object 2 to shorten the time to organize the object and makes the organization process easy and convenient.

To this end, the holder for organization 1 according to an embodiment of the present invention may comprise at least one of the main body 10, the opening and closing units 20, and the holder unit 30.

The main body 10 has an accommodation space 10*a* in which the to-be-organized object 2 is accommodated, and one side thereof is cut to form an entrance 10*b*.

Through the entrance 10*b*, the to-be-organized object 2 may be inserted into the accommodation space 10*a*, or the to-be-organized object 2 may be taken out from the accommodation space 10*a*.

Although the figure shows an example in which the main body 10 is formed in a 'C'-shaped cross-sectional shape and has a shackle structure, the main body 10 may be formed in any shape as long as it has a structure capable of accommodating the to-be-organized object 2.

Further, the to-be-organized object 2 may be a cable tie, a disposable bag, a straw, or other various things, and the figure shows an example in which the to-be-organized object 2 is applied as a cable tie.

The opening and closing units 20 maintain the closed state of the entrance 10*b*. Further, when the opening and closing units 20 are pressed by the to-be-organized object 2, the entrance 10*b* is opened, and the to-be-organized object 2 is passed through the accommodation space 10*a*.

To this end, rails 11 are formed on one side and the other side of the entrance 10*b* of the body unit 10, respectively, and opening and closing units 20 are configured as a pair and mounted on the rails 11, respectively.

One side of the opening and closing units 20 is opened, and an empty space in which the rails 11 may be accommodated is formed therein.

For example, the respective opening and closing units 20 may include a first member 21 and a second member 22 that jointly surround the rails 11.

The first member 21 and the second member 22 are formed to correspond to each other.

The first member 21 and the second member 22 may be bolted to each other.

As the first member 21 and the second member 22 are detachably coupled, the opening and closing units 20 may be easily installed on the rails 11.

In this state, the opening and closing units 20 open or close the entrance 10*b* while sliding in a direction moving away from each other or approaching each other.

When the two opening and closing units 20 face each other, they close the entrance 10*b* with their faces in contact.

That is, one opening and closing unit 20 opens or closes about ½ of the entrance 10*b*, and the other opening and closing unit 20 opens or closes the remaining area of the entrance 10*b*.

Furthermore, the opening and closing units 20 are formed in a substantially rectangular shape, and inclined surfaces 20*a* are formed on the surfaces facing each other of the opening and closing units 20, respectively, for inducing the opening and closing units to slide in an opening direction of the entrance 10*b* by being pressed by the to-be-organized object 2.

The inclined surfaces 20*a* may be formed to have a length of 20 to 30% of the length of the opening and closing units 20.

The inclined surfaces 20*a* are formed so that the angle of inclination gradually increases in a direction away from the ends facing each other.

Further, return units are installed on the rails 11 to automatically return to the original position, that is, to the closed position when the opening and closing units 20 slide in the direction of opening the entrance 10*b*.

The return units 40 are formed of an elastic material and elastically supports the opening and closing units 20.

For example, the return units 40 may be formed of a coil spring or a leaf spring.

The figures show an example in which the return units 40 are formed of a coil spring.

One end of the return units 40 is fixed to the rails 11, and the other end is fixed to the inner wall surface of the opening and closing units 20.

The return units 40 are compressed when the opening and closing parts 20 slide in the opening direction.

Then, when an external force or pressing force on the opening and closing units 20 disappears, the return units 40 expand to return the opening and closing units 20 to its original position. Thus, the opening and closing units 20 automatically close the entrance 10*b* of the main body 10.

Meanwhile, the holder unit 30 presses and holds the to-be-organized object 2 accommodated in the accommodation space 10*a* through the opening and closing units 20 toward the opening and closing units 20.

To this end, the holder unit 30 may include at least one or more of a pressure bar 31, a pivoting shaft 32, a pressing force generating unit 33, and a friction unit 35.

The pressure bars 31 are configured as a pair and are disposed to face each other with the main body 10 interposed therebetween.

The pressing bars 31 are formed to have a length crossing the width of the accommodation space 10*a*.

Accordingly, the left and right sides of the pressure bar 31 may face the left and right sides of the main body 10, respectively, at the inlet side.

A surface facing the to-be-organized object 2 inserted into the accommodation space 10*a* of the pressure bars 31 may be formed in a curved shape or a combination of a straight line, a curved line, and an oblique line.

The shape of the surface facing the to-be-organized object 2 of the pressure bars 31 may vary depending on the shape of the to-be-organized object 2.

The figure shows an example in which the to-be-organized object 2 is applied as a cable tie, and the surface of the pressure bar 31 facing the to-be-organized object 2 may be formed in a curved shape to efficiently press the cable ties gathered in one place.

These pressure bars 31 are connected through one rotation limiting unit 36.

The rotation limiting unit 36 may be formed in a pin shape. One side and the other side of the rotation limiting unit 36 are respectively coupled to the pressure bar 31 disposed to be spaced apart from each other.

One side and the other side of the rotation limiting part 36 may be respectively coupled in a form embedded in the pressure bar 31.

The rotation limiting unit 36 is in contact with any one of opening and closing units 20 to limit the rotation angle of the pressure bar 31.

The rotation limiting unit 36 may be received in the receiving groove 10*c* formed in the main body 10 when the pressure bar 31 is rotated in a direction away from the entrance.

The pivoting shaft 32 is installed through one of the pressure bars 31 and the main body 10 and the other pressure bar 31 in common.

At this time, the pivoting shaft 32 passes through the central empty space of the pressing force generating unit 33 formed of a coil spring.

Installation holes 10*d* and 31*a*, which are positioned on the same line with each other and through which the pivoting shaft 32 is installed, respectively. may be formed on one side of the pressure bar 31 and one side of the main body 10.

The figure shows an example in which the pivoting shaft 32 is formed of a bolt, the nut 321 is fastened to the end of the pivoting shaft 32 located in the installation hole of any one of the pressure bars 31 to prevent the pivoting shaft 32 from being separated from the pressure bars 31.

At this time, the pressure bars 31 and the pivoting shaft 32 may be rotated in a forward or reverse direction together, or the pressure bar 31 may be rotated in a forward or reverse direction with respect to the pivoting shaft 32.

The pressing force generating unit 33 is a component that generates a pressing force of the pressure bars 31 for the to-be-organized object 2 located in the accommodation space 10*a*.

The pressing force generating unit 33 is formed of an elastic material and elastically supports the pressure bars 31.

For example, the pressing force generating unit 33 may be formed of a coil spring or a leaf spring.

The figures show an example in which the pressing force generating unit 33 is formed of a coil spring.

This pressing force generating unit 33 are configured as a pair and are disposed between the main body 10 and the pressure bar 31, respectively.

At this time, a certain area of the pressing force generating unit 33 may be received in the receiving groove 10*e* formed in the main body 10, and the remaining area may be received in the receiving groove 31*b* formed in the pressure bars 31.

The pressing force generating unit 33 may include a first coupling piece 331 and a second coupling piece 332.

The first coupling piece 331 may be fixed to the fixing hole 10*f* of the main body 10 while being received in the receiving groove 10*e* together with the pressing force generating unit 33. The second coupling piece 332 is fixed to the receiving groove 31*b* formed in the pressure bars 31. Through the first coupling piece 331 and the second coupling piece 332, the elastic force of the pressing force generating unit 33 may be applied to the pressure bar 31.

Therefore, when an external force is applied to the pressure bars 31 to push it in a direction away from the entrance 10*b*, and then the external force is excluded, the pressure bars 31 move toward the entrance 10*b* again by the elastic force of the pressing force generating unit 33. The pressing bar 31 may press the to-be-organized object 2 by means of the pressing force generating unit 33.

The friction units 35 are installed on one side of the pressure bars 31, that is, on the surface facing the to-be-organized object 2, respectively, to come into contact with at least one of the to-be-organized object 2 located in the accommodation space 10*a*.

The friction units 35 are made of a rubber material having an excellent coefficient of friction to prevent the to-be-organized object 2 from being separated from the accommodating space 10*a*.

Next, examples of use and unique effects of the holder for organization 1 according to an embodiment of the present invention described above are described with reference to FIGS. 5 and 6.

First, a certain number of cable ties, which are the to-be-organized objects 2, are gripped with one hand, and the main body 10 is gripped with the other hand.

At this time, the figure shows a state in which the main body 10 is inverted and the to-be-organized object 2 is erected vertically, but the main body 10 is erected vertically so that the entrance 10*b* faces upward or toward the ground, and the to-be-organized object 2 is inverted horizontally, then the to-be-organized object 2 may be organized.

Thereafter, the central portion of the to-be-organized object 2 is brought into contact with the inclined surface 20*a* of the opening and closing units 20 and then pressed.

At this time, the pressing portion of the to-be-organized object 2 against the inclined surface 20*a* is not limited to the central portion. That is, any area between the top and bottom other than the central portion of the to-be-organized object 2 may be brought into contact with the inclined surface and then pressed.

When the to-be-organized object 2 is pressed against the inclined surface 20*a*, the pair of opening and closing units 20 slide in a direction away from each other, and the entrance 10*b* is opened. Accordingly, the to-be-organized object 2 passes through the entrance 10*b* and is introduced into the accommodation space 10*a* of the main body 10.

When the to-be-organized object 2 is introduced into the accommodation space 10*a*, the opening and closing units 20 are quickly returned to their original position by the return units 40 to close the entrance 10*b*.

Further, the pressure bar 31 is pushed by the to-be-organized object 2 entering the accommodating space 10*a* to rotate in a direction away from the entrance 10*b* but press the to-be-organized object 2 by the pressing force generating unit 33.

Therefore, the to-be-organized object 2 is held by being pressed between the pressure bar 31 and the opening and closing units 20.

As described above, in the holder for organization 1 according to an embodiment of the present invention, any area between the upper and lower ends of the to-be-organized object presses the inclined surface 20*a* to be introduced into the accommodation space 10*a*, and accordingly, it can very easily and conveniently organize a large number of the to-be-organized objects 2 at one time compared to prior art.

In particular, a downwardly inclined protruding area 2*a* is formed on the lower side of the cable tie. and thus the holder for organization 1 according to an embodiment of the present invention can organize cable ties while preventing the protruding area 2*a* from contacting any elements such as the main body 10, the opening and closing units 20, and the pressure bars 31, thereby improving the convenience of use compared to the prior art.

Furthermore, the holder for organization 1 according to an embodiment of the present invention arranges a certain number of to-be-organized objects 2 in the accommodation space 10*a* of the main body 10, and then a new to-be-organized object 2 can be easily further organized.

Specifically, it is a structure in which the to-be-organized objects 2 previously organized in the accommodation space 10*a* of the main body 10 are pressed between the pressure bars 31 and the opening and closing units 20 to maintain a held state, and the opening and closing units 20 supports the to-be-organized objects 2 while closing the entrance 10*b* as soon as the to-be-organized objects 2 passe by the return units 40, so that when one or more new to-be-organized objects 2 are pressed against the inclined surface, while sliding by a distance corresponding to the number or thickness of the to-be-organized objects 2, the opening and closing units 2 open and close the entrance 10*b* to support new to-be-organized objects.

That is, as soon as the new to-be-organized object 2 is introduced into the accommodation space 10*a*, the opening and closing units 20 close the entrance 10*b*, and the pressing force is always applied to the pressure bars 31 by the pressing force generating unit 33, so that the new to-be organized object 2 is pressed and held between the previously to-be-organized object 2 and the opening and closing units 20 by the pressing force of the pressure bars 31.

Further, since the opening and closing operation of the opening and closing units 20 with respect to the entrance 10*b* is instantaneously performed by the return units 40, the previously organized to-be-organized object 2 is prevented from falling or leaving the accommodation space 10*a*.

Furthermore, as more new to-be-organized objects 2 are added to the accommodation space 10*a*, the pressure bars 31 are pushed in a direction away from the entrance 10*b*, while the previously organized to-be-organized objects 2 are pressed by the pressing force generating unit 33, and therefore, it is possible to hold a large number of to-be-organized objects at a time in the accommodation space 10*a*, and it is also possible to add a predetermined number of the to-be-organized objects 2 and hold them in the accommodation space 10*a* as needed.

Further, since the interaction of the opening and closing units 20, the return units 40, the pressing force generating unit 33, and the pressing bar 31 always generates a pressing force against the to-be-organized objects 2, although a new to-be-organized object 2 is added and introduced into the accommodation space 10*a* in various states such as a state in which the to-be-organized objects 2 are erected vertically, and the main body 10 is inverted horizontally, and a state in which the to-be-organized objects 2 are inverted horizontally, and the main body 10 is erected vertically, a phenomenon in which the previously arranged to-be-organized objects 2 are separated or dropped from the receiving space 10*a* does not occur at all.

Further, as needed, it is possible to pull out and use one by one from the to-be-organized objects 2 organized in the accommodation space 10*a*, based on FIG. 6, and when trying to withdraw all the to-be-organized objects 2 organized in the accommodation space 10*a* at once, it is also possible to selectively pull the pressure bars 31 in a direction away from the entrance 10*b* and then pull and use the to-be-organized objects 2.

Those skilled in the art to which the present invention pertains understand that the present invention can be embodied in other specific forms without changing its technical spirit or essential features. Therefore, the embodiments described above should be understood as illustrative in all respects and not limiting. It should be interpreted that the scope of the present invention is indicated by the claims to be described later rather than the detailed description above, and all changes or modifications derived from the meaning and scope of the claims and equivalent concepts thereof are included in the scope of the present invention.

The invention claimed is:

1. A holder for organization comprising:

a main body configured to have an accommodation space for accommodating a to-be-organized object therein and an entrance formed on one side of the main body for introducing or withdrawing the to-be-organized object into the accommodation space;

opening and closing units configured to close the entrance and open the entrance while sliding when pressed by the to-be-organized object; and a holder unit configured to press and hold the to-be-organized object passing through the opening and closing unit and accommodated in the accommodation space toward the opening and closing units, wherein the holder unit comprises:

a pair of pressure bars disposed opposite to each other with the main body interposed therebetween;

a pivoting shaft installed through the main body and the pressure bars to guide the pressure bars to rotate; and pressing force generating units disposed on one side and the other side of the main body, respectively, and elastically pushing the pressing bar toward the entrance to generate a pressing force of the pressing bar for the to-be-organized object located in the accommodation space.

2. The holder of claim 1, wherein rails are formed on one side and the other side of the entrance of the main body, respectively, and wherein the opening and closing units are configured as a pair and open and close the entrance while sliding in a direction moving away from each other or approaching each other while being mounted on the rails, respectively.

3. The holder of claim 2, wherein surfaces facing each other of the opening and closing units are in contact with each other, and wherein the opening and closing units further comprise return units installed on the rails and elastically supporting the opening and closing units to return the opening and closing unit to its original position when the opening and closing units slide in the direction of opening the entrance.

4. The holder of claim 2, wherein inclined surfaces are formed on the surfaces facing each other of the opening and closing units, respectively, for inducing the opening and closing units to slide in an opening direction of the entrance by being pressed by the to-be-organized object.

5. The holder of claim 1, wherein the holder unit further comprises:

friction units installed on one side of the pressure bars, respectively, for contacting the to-be-organized object located in the accommodation space; and a rotation limiting unit connecting the pressure bars and limiting a rotation angle of the pressure bar by contact with the opening and closing units.

* * * * *